US010011379B2

(12) United States Patent
Baltes et al.

(10) Patent No.: US 10,011,379 B2
(45) Date of Patent: Jul. 3, 2018

(54) APPARATUS AND METHOD FOR REDUCING RESTORING FORCES OF PACKAGE SLEEVES IN A FILLING MACHINE

(71) Applicant: ELOPAK SYSTEMS AG, Glattbrugg (CH)

(72) Inventors: Klaus Baltes, Bergheim (DE); Andre Vetters, Dresden (DE)

(73) Assignee: ELOPAK SYSTEMS AG, Glattbrugg (CH)

( * ) Notice: Subject to any disclaimer, the term of this patent is extended or adjusted under 35 U.S.C. 154(b) by 823 days.

(21) Appl. No.: 14/389,699

(22) PCT Filed: Mar. 15, 2013

(86) PCT No.: PCT/EP2013/055477
§ 371 (c)(1),
(2) Date: Sep. 30, 2014

(87) PCT Pub. No.: WO2013/143892
PCT Pub. Date: Oct. 3, 2013

(65) Prior Publication Data

US 2015/0068163 A1 Mar. 12, 2015

(30) Foreign Application Priority Data

Mar. 30, 2012 (DE) ..... 10 2012 102 812

(51) Int. Cl.
*B65B 43/24* (2006.01)
*B65B 43/18* (2006.01)
(Continued)

(52) U.S. Cl.
CPC ..... *B65B 43/24* (2013.01); *B65B 43/185* (2013.01); *B65B 43/285* (2013.01); *B31B 50/782* (2017.08)

(58) Field of Classification Search
CPC ..... B31B 5/78; B31B 5/782; B31B 2120/30; B31B 1/78; B31B 1/76; B31B 1/80;
(Continued)

(56) References Cited

U.S. PATENT DOCUMENTS 3,293,998 A * 12/1966 Farnow ..... B65B 43/305 271/194
3,534,667 A * 10/1970 Krause ..... 493/181
(Continued)

FOREIGN PATENT DOCUMENTS

CN 101631669 A 1/2010
DE 558108 9/1932
(Continued)

*Primary Examiner* — Hemant M Desai
*Assistant Examiner* — Valentin Neacsu
(74) *Attorney, Agent, or Firm* — Lucas & Mercanti, LLP

(57) ABSTRACT

A method for reducing restoring forces of package sleeves in a filling machine, where flat-folded package sleeves are removed from a magazine of the filling machine, erected to form a package sleeve forming a parallelogram in cross-section and then transferred to a transport device for transporting the upright package sleeve along a transport path. In order to enable a reduction in the restoring force adapted to the particular material of the package sleeve without increasing the cycle time for the removal and unfolding of the flat-folded package sleeve, the restoring force is reduced by temporarily increasing the internal angle between the package walls at the outer fold edges to more than 90° while the upright package sleeve is located on the transport path of the transport device. The reduction of the restoring force can be accomplished during the movement or during a standstill of the package sleeve on the transport path.

15 Claims, 6 Drawing Sheets

(51) Int. Cl.
*B65B 43/28* (2006.01)
*B31B 50/78* (2017.01)

(58) Field of Classification Search
CPC ..... B31B 2201/282; B31B 2201/28; B31B 2201/281; B65B 43/185; B65B 43/24; B65B 43/285; B65B 43/325
USPC ..... 493/309–310; 53/141, 492
See application file for complete search history.

(56) References Cited

U.S. PATENT DOCUMENTS 4,285,679 A * 8/1981 Wahle ..... B31B 50/00 493/125
4,331,436 A * 5/1982 Kuttenbaum ..... B31B 50/00 493/310
4,573,957 A 3/1986 Billberg
5,007,889 A * 4/1991 Wakabayashi ..... B31B 50/00 493/122
5,033,975 A * 7/1991 Traegaardh ..... B65B 43/325 493/310
5,162,033 A * 11/1992 Wakabayashi ..... B65B 43/285 493/122
5,382,217 A * 1/1995 Namowitz ..... B31B 50/00 493/310
5,536,231 A * 7/1996 Nilsson ..... B31B 50/00 493/312
5,715,657 A 2/1998 Mondani
8,277,367 B2 10/2012 Jannin
2014/0260119 A1 9/2014 Baltes

FOREIGN PATENT DOCUMENTS

DE 559508 9/1932
DE 577394 5/1933
DE 1761556 U 2/1955
DE 933918 10/1955
DE 4142167 6/1993
EP 0339116 11/1989
EP 0356824 3/1990
EP 0356824 A1 3/1990
EP 0936992 8/1999
EP 0978453 2/2000
EP 0978453 A1 2/2000
EP 2748069 A1 7/2014
GB 425266 3/1935
JP 06-286729 11/1994

* cited by examiner

Figure 10a)
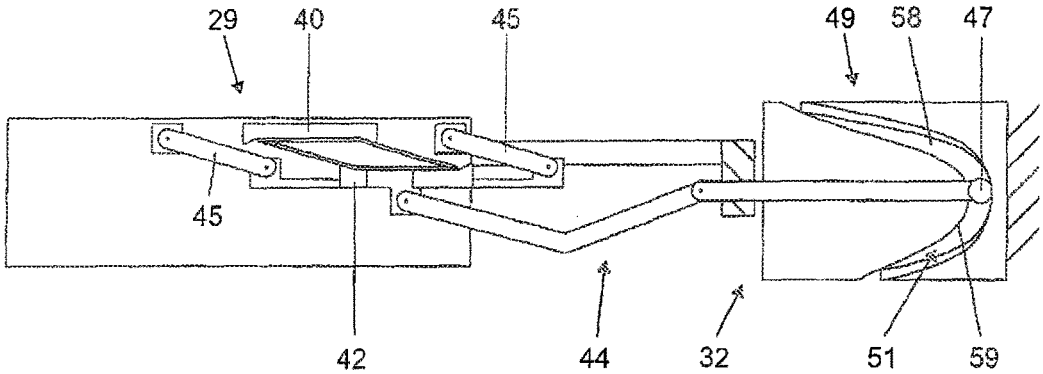
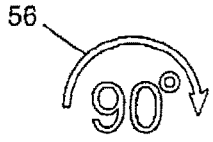
Figure 10b)
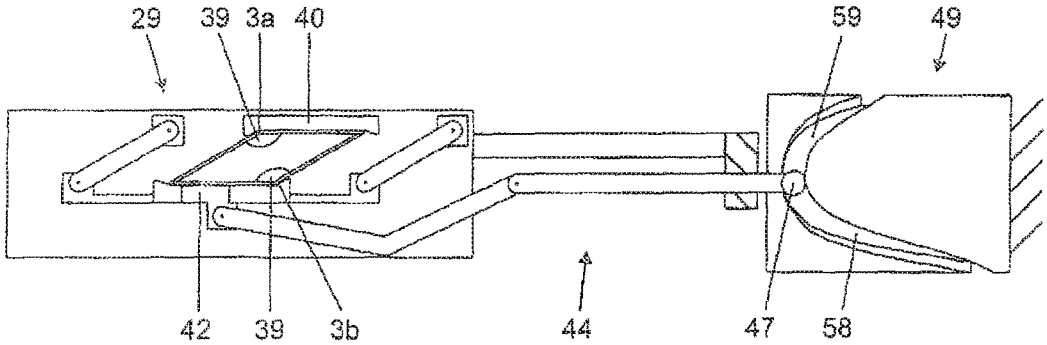
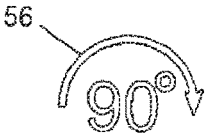
Figure 10c)
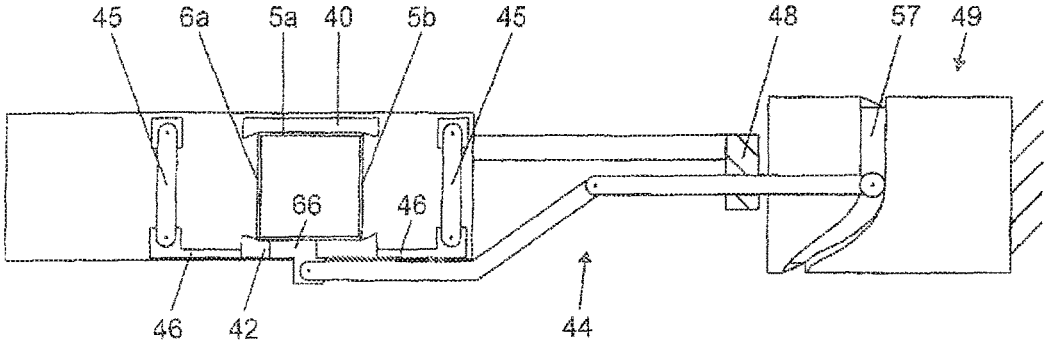

APPARATUS AND METHOD FOR REDUCING RESTORING FORCES OF PACKAGE SLEEVES IN A FILLING MACHINE

CROSS-REFERENCE TO RELATED APPLICATIONS

This application is a 371 of PCT/EP2013/055477 filed Mar. 15, 2013, which in turn claims the priority of DE 10 2012 102 812.5 filed Mar. 30, 2012, the priority of both applications is hereby claimed and both applications are incorporated herein by reference.

BACKGROUND OF THE INVENTION

The invention relates to a method for reducing restoring forces of package sleeves in a filling machine, wherein each flat-folded package sleeve comprises four package walls separated from one another by parallel-running outer and inner fold edges and at the outer fold edges respectively one acute internal angle is enclosed between the package walls, comprising the process steps

- inserting flat-folded package sleeves into a magazine of the filling machine,
- removing respectively one flat-folded package sleeve from the magazine and
- unfolding the flat-folded package sleeve to form an upright package sleeve forming a parallelogram in cross-section by means of a removal and unfolding apparatus and
- transferring the upright package sleeve by means of a transfer apparatus to a transport device for transporting the upright package sleeve along a transport path, where at least one processing step is carried out on the upright package sleeve whilst the upright package sleeve is located on the transport path of the transport device.

Filling machines for filling products, in particular liquid foodstuffs, into packaging containers consisting of cardboard composite material are known from the prior art. For the structure of known filling machines, reference is made, for example, to EP 0 936 992 B1 and DE 41 42 167 C2.

On account of better transportability, the usually rectangular packaging containers are only produced in the filling machine from packaging blanks provided with fold edges and welded together to form package sleeves. Each flat-folded package sleeve has four package walls separated from one another by four parallel-running outer and inner fold edges. At the outer fold edges of the flat-folded package sleeve, an acute angle is enclosed in each case between the package walls. The inner fold edges of the flat-folded package sleeve are disposed between the outer fold edges. At the inner fold edges of the flat-folded package sleeve, an obtuse internal angle is enclosed in each case between the package walls. If the package walls have the same dimensions, the inner fold edges divide the section between the outer fold edges at the centre.

The flat-folded package sleeves from a magazine are supplied to the at least one conveyor line of the filling machine. In the magazine the package sleeves are disposed consecutively as stacks, usually upright. On a removal side of the magazine pointing in the direction of the conveyor line, two of the four package walls of the respectively front package sleeve are exposed. On its rear side the stack is acted upon by a force in the direction of the removal side, for example, that of a spring or a linear drive in order to displace the package sleeves of the stack towards the removal side.

A removal and unfolding apparatus comprises a gripper for gripping one of the two package walls exposed on the removal side of the magazine, a guide for the other one of the two exposed package walls and retaining elements disposed in the direction of movement after the guide for receiving the outer fold edges of the unfolded package sleeve.

The removal and unfolding apparatus unfolds the initially flat-folded package sleeve to form a package sleeve forming a rectangle in cross-section. The unfolded package sleeve is transferred by a transport device. Along the conveyor line of the filling machine, the packaging containers produced from the package sleeves are sterilised, filled and then closed. The package base is usually produced directly before filling. Then the package top is usually produced.

In particular, transport wheels or revolving conveyor belts having pocket-shaped receptacles for the unfolded package sleeves or packaging containers are used as the transport device. The stepwise rotating transport wheels have a plurality of radially outwardly extended parallel receptacles. The receptacles are usually configured as mandrels onto which the unfolded package sleeves or packaging containers are slid; we then talk of a mandrel wheel. In another embodiment of such a transport wheel, each receptacle has a plurality of arms or profiles which come to rest on the outer side, in particular directly adjacent to the fold edges of the unfolded package sleeve or the packaging container. In this case, the receptacles form cells into which the unfolded package sleeves or packaging containers can be inserted; we then talk of a cell wheel.

A filling machine with removal and unfolding apparatus pertaining to the prior art, made by SIG Combibloc GmbH, D-52441 Linnich is explained in detail hereinafter with reference to FIG. 1*a*)-*d*):

The flat-folded package sleeves (1) are stored upright in the magazine (2) of the filling machine. Each flat-folded package sleeve (1) has four package walls (5*a*, 5*b*, 6*a*, 6*b*) separated from one another by parallel running outer fold edges (3*a*, 3*b*) and inner fold edges (4*a*, 4*b*).

A removal side (7) of the magazine (2) exposes the two forwardly pointing package walls (5*a*, 5*b*) of the respectively front package sleeve (1). In order that the package sleeves (1) do not fall out of the magazine on the removal side (7), retaining elements (8*a*, 8*b*) are disposed on the removal side (7), which elements extend along the outer fold edges (3*a*, 3*b*) of the front package sleeve (1). The respectively front package sleeve (1) is not removed in the full width of the two package walls (5*a*, 5*b*). On the contrary, the package sleeve (1) is merely gripped at one of the two exposed package walls (5*a*) of the package sleeve (1) on the removal side (7) of the magazine (2) (cf. FIG. 1*a*)). A suction gripper (9) fastened on a pivot arm (11) disposed pivotably about an axis (10) is used to grip the package wall (5*a*). As a result of a pivoting movement of the suction gripper (9) executed about the axis (10), the outer fold edge (3*a*) is initially released from the retaining element (8*a*), whereby during the subsequent pivoting movement of the suction gripper (9) about the opposite outer fold edge (3*b*), which is still held by the retaining element (8*b*), a flat parallelogram is formed as can be identified in particular from FIG. 1*a*). In the course of the further pivoting movement, the outer fold edge (3*b*) is initially released from the retaining element (8*b*). The package sleeve (1) with the other of the two exposed package walls (5*b*) is then guided slidingly along a curved guide surface (12) of a guide element (13). During the movement of the package sleeve (1) along the movement path (14) the guide surface (12) brings about an increase in the acute internal angles (15*a*, 15*b*), where the internal angle (15*a*) is enclosed between the package walls (5*b*, 6*b*) and the internal angle (15*b*) is enclosed between the package walls (5*a*, 6*a*). Located at the end of the curved guide surface (12) in the direction of the movement path (14) is a retaining element (16) that is introduced into the guide element (13) in the form of a groove-shaped recess. The retaining element (16) is used to receive the outer fold edge (3*b*) of the unfolded package sleeve (1). Located likewise in the direction of the movement path (14) after the guide surface (12) is another fixed retaining element (17) in the form of a retaining strip (17) for receiving the diametrically opposite outer fold edge (3*a*). The spacing and the alignment of the retaining elements (16, 17) is accomplished in such a manner that the package sleeve received by the retaining elements (16, 17) forms a rectangle in cross-section. This alignment is necessary for transferring the completely unfolded package sleeve to the transport device located downstream of the removal and unfolding apparatus such as in particular the transport wheels mentioned initially.

Since the package sleeves (1) have been stored or transported for a long time in the flat-folded state before introduction into the machine, the fold edges (3*a*, 3*b*, 4*a*, 4*b*) of the package sleeve (1) give rise to restoring forces which counteract the unfolding of the package sleeve (1). The restoring forces increase with the unfolding of the initially flat-folded package sleeve (1) to form a parallelogram in cross-section, in particular a package sleeve forming a rectangle.

In order to reduce the restoring forces, the package sleeves (1) are moved somewhat beyond the rectangular cross-section with the aid of the sucker at the end of the curved guide surface (12) so that the initially acute internal angle (15*a*, 15*b*) of the package sleeve is briefly slightly more than 90°, as can be seen from FIG. 1*c*).

The package sleeve (1) can thereby be overstretched in the unfolded fold edges (3*a*, 3*b*) so that after erecting, the package sleeve (1) adopts and retains the desired rectangular or square cross-section (FIG. 1*d*)) as accurately as possible.

The overstretching of the fold edges is, however, only successful to a limited extent since the package sleeve must be overstretched a little more or a little less depending on the condition of the cardboard. However, as a result of the constant movement path (14) of the suction gripper (9), an individual overstretching is not possible. In addition, the additional movement of the suction gripper (9) for the overstretching takes time, thus lengthening the removal and unfolding cycle. This lengthening of the cycle reduces the working speed of the entire filling machine.

In order not to restrict the speed of the filling machine too severely despite the overstretching, the package sleeves are removed and unfolded at the highest possible speed. As a result, a large amount of noise is generated when the fold edges (3*a*, 3*b*) snap into the retaining elements (16, 17).

EP 0 978 453 A discloses a removal and unfolding apparatus for the removal of a flat-folded package sleeve from a magazine and for unfolding the removed package sleeve, which transfers the package sleeve, which is partially erected in cross-section to form a parallelogram, to a transport device comprising two revolving belts for transporting the upright package sleeve along a transport path. During the transfer to the transport device, the package sleeve is briefly overstretched by means of a folding means which is pivotably disposed on the removal and unfolding apparatus. The restoring forces are reduced by the overstretching.

EP 0 356 824 A1 discloses a method for unfolding a flat-folded package sleeve by means of an erecting apparatus in which the flat-folded package sleeves are introduced by means of a lifting conveyor between discharging rollers and conveyed obliquely upwards. With the aid of a pushing device and supports, the flat folded package sleeve is unfolded in the erecting apparatus, where the internal angles between the package walls at the outer fold edges are increased to approximately 180°. This results in a reduction in the restoring forces. The pushing device is then moved away from the side of the discharging rollers, where the pushing device adopts a central position so that the package sleeve relaxes to a square cross-section and retains this. An unloading conveyor device then pushes the package sleeve which has been erected to a square cross-section, onto a mandrel wheel.

EP 0339 116 A2 discloses a method for reducing restoring forces of package sleeves in a carton erecting apparatus, where the flat-folded package sleeves are removed individually from the magazine by means of a revolving conveyor with suction cups and are erected by means of guide elements to form a package sleeve forming a rectangle in cross-section. The conveyer transfers the upright package sleeve directly to means for reducing the restoring force which comprises two revolving upper conveyor belts and two revolving lower conveyor belts with projections disposed thereon. The two upper conveyor belts form a tapering shaft on the inlet side which has the effect that the internal angles between the package walls are increased to 180° at the outer fold edges whilst the package sleeve runs through the shaft. The package sleeve folded flat in such a manner then enters a station for re-erection of the flat-folded package sleeve. After re-erection of the flat-folded package sleeve, said sleeve is passed onto an unloading conveyor which conveys the upright package sleeve to a filling machine.

DE 933 918 B discloses an apparatus for reducing the restoring force of an upright package sleeve in a filling machine, in which the flat-folded package sleeve is removed from a magazine from below with the aid of a removal sword and erected to a package sleeve forming a rectangle in cross-section. In order to reduce the restoring force, a stress-relieving straight edge is applied to the surface of the upright package sleeve, which executes a swinging movement about the lower fold box edge. During the reduction of the restoring force, the removal sword holds the upright package sleeve firmly on a base and specifically until the package sleeve is completely folded flat by the stress-relieving straight edge. The package sleeve is then transported further with the aid of a conveying means.

U.S. Pat. No. 5,007,889 A discloses an apparatus for removing and unfolding a flat-folded package sleeve from a magazine, where the unfolding of the package sleeve is accomplished by means of an unfolding arm. During the removal of the package sleeve by means of suction grippers disposed on a pivoting arm, the restoring force of the package sleeve is simultaneously reduced, since the internal angle θ is temporarily increased to more than 90° by means of the unfolding arm.

BRIEF SUMMARY OF THE INVENTION

An object of the invention to provide a method which enables a reduction in the restoring force adapted to the particular material of the package sleeve without increasing the cycle time for the removal and unfolding of the flat-folded package sleeve compared to the prior art. A filling machine for carrying out the method is furthermore to be proposed.

The solution of this object is based on the idea of decoupling the reduction of the restoring forces of the package sleeve from the removal and unfolding process. In detail, the object is solved by a method for reducing restoring forces of package sleeves in a filling machine, whereby the restoring force is reduced by temporarily increasing the internal angle between the package walls at the outer fold edges to more than 90° whilst the upright package sleeve is located on the transport path of the transport device. The reduction of the restoring force is accomplished with the aid of an apparatus for reducing the restoring force disposed on the transport device, which is independent of the removal and unfolding apparatus.

The invention uses free time windows on the transport path of the transport device located downstream of the removal and unfolding apparatus for reducing the restoring force. It is thereby possible to carry out an adapted overstretching with shorter cycle times for the unfolding and removal process. The shortened cycle times allow a higher working speed of the entire filling machine. The free time windows in the stepwise-driven downstream transport devices are formed by unused standstill positions and/or movement phases of the package sleeve along the transport path. The at least one processing step, in particular the formation of the package base, is carried out during one standstill interval at a processing station along the transport path. At standstill positions of the package sleeve, for example, between a transfer position of the transport device and the processing station, the standstill position has hitherto not been used. The movement phase between the transfer position and the processing station has also hitherto not been used to act on the package sleeve.

As a result of the adapted overstretching and reduction of the restoring force, the friction of the package sleeves during insertion and withdrawal from the receptacle of a transport wheel is reduced; it is also prevented that the completely upright package sleeve is twisted into itself.

A filling machine for carrying out the method according to the invention is characterised by an apparatus disposed on the transport device, independent of the removal and restoring force, for reducing the restoring force in the upright package sleeve by temporarily increasing the internal angle between the package walls at the outer fold edges to more than 90°. The removal and unfolding apparatus unfolds the initially flat-folded package sleeve to an upright package sleeve forming a parallelogram in cross-section. During the unfolding to an upright package sleeve the package sleeve acquires a rectangular cross-section at most. The removal and unfolding apparatus in particular brings about no reduction in the restoring force since the package sleeve is unfolded beyond the rectangular cross-section and as a result, the internal angle between the package walls at the outer fold edges is increased to more than 90°.

The downstream transport device is operated in a stepwise manner in order to allow a problem-free transfer of the upright package sleeve to the transport device and in order to execute the at least one processing step on the upright package sleeve such as in particular forming the base of the packaging container.

The standstill times produced during the stepwise operation of the transport device are preferably used not only to execute the at least one working step but also to reduce the restoring force. Alternatively, however, the restoring force can also be reduced during a movement of the upright package sleeve along the transport path.

A method for reducing the restoring force preferably used during the standstill of the stepwise-operated transport device consists in moving the outer fold edges towards one another in the direction of a cross-sectional diagonal between the outer fold edges of the upright package sleeve so that the internal angle between the package walls at the outer fold edges is increased to more than 90°. Over the movement length the requisite overstretching can be adapted to the magnitude of the material-dependent restoring forces.

A method for reducing the restoring force during a movement of the upright package sleeve along the transport path of a stepwise-operated transport device is characterised in that the internal angle between the package walls at the outer fold edges is increased to more than 90° by pivoting two opposite package walls parallel to one another in each case about one of the two outer fold edges. The magnitude of the reduction in the restoring force is adjusted by the size of the pivot angle of this parallel pivoting movement.

For the composite materials usually used to manufacture packaging containers, it has been found that the internal angle between the package walls at the outer fold edges is preferably increased to an angle in the range between 120° to 180° to reduce the restoring force. Such an increase was no longer acceptable in more modern filling machines in the interests of reasonable cycle times for the removal-unfolding process. According to the invention, as a result of the now available time window on the transport path of the downstream transport device, it is even possible to repeatedly increase the internal angle between the package walls at the outer fold edges temporarily to more than 90°, in particular to at least 120°.

As a result of its compact design and suitability for stepwise operation, the transport device located downstream of the removal and unfolding apparatus is configured as a transport wheel having a plurality of radially outwardly extending receptacles for respectively one package sleeve, each receptacle has a plurality of profiles which can be brought to rest against and/or adjacent to the fold edges of the package sleeve and the transport device has a drive for turning the transport wheel about an axis of rotation. Common transport wheels in filling machines have four receptacles uniformly distributed over the circumference of the axis of rotation. The drive of the transport wheel is configured as a stepping drive by which means the receptacles for the package sleeves can be brought into a standstill position after turning the transport wheel by a step angle, in particular of 90°. After transferring the upright package sleeve in a transfer position to the downstream transport wheel, the transport wheel turns further through the step angle so that another receptacle of the transport wheel turns into a position in alignment with the retaining elements of the removal and unfolding apparatus. Another package sleeve is inserted into this further receptacle immediately following the rotational movement. By turning the transport wheel, the receptacle previously loaded with a package sleeve comes into an, in particular horizontal, standstill position.

The apparatus for reducing the restoring force is either activated whilst the transport wheel is at a standstill or during the rotation of the transport wheel through the aforesaid step angle.

An apparatus for reducing the restoring force whilst the transport wheel is at a standstill can be integrated particularly favourably in the filling machine if each receptacle has at least one first profile that can be brought to rest against one of the two outer fold edges of the package sleeve and the receptacle has at least two second profiles which can be brought to rest against the other of the two outer fold edges of the package sleeve.

The restoring force of the upright package sleeve forming a rectangle in cross-section has the effect that the package sleeve is securely held in the receptacle having at least three profiles. If the receptacle has only a first profile, this is preferably designed as an angle profile that can be brought to rest against the fold edge. The two second profiles which can be brought to rest against the opposite outer fold edge are preferably designed as rods.

In a transport wheel configured with such first and second profiles, a push element which can be brought temporarily to abut against at least one of the two outer fold edges, which is adapted in such a manner that it can be moved in the direction of the cross-sectional diagonal running between the outer fold edges of the upright package sleeve is preferably provided as apparatus for reducing the restoring force whilst the transport wheel is at a standstill. The distance of the second profile from the outer fold edge is preferably determined so that the push element can be moved through the rods in the direction of the outer fold edge. Whilst the transport wheel is at a standstill, the fixedly mounted push element compresses the package sleeve along the cross-sectional diagonal whereby the internal angle between the package walls at the outer fold edges is increased to more than 90°. The travel length of the push element in the direction of the cross-sectional diagonal is thus determined until the restoring force is broken. The package sleeve is thereby supported on the first profile of the receptacle. After withdrawal of the push element, the package sleeve is re-erected to such an extent until it again comes to rest on the two second profiles.

In one embodiment of the invention the receptacle has a first and a second profile, each configured as an angle profile, which can be brought to rest against the outer fold edges. One of the two angle profiles has a section configured as a push element which can be moved temporarily in the direction of the cross-sectional diagonal running between the outer fold edges of the upright package sleeve.

An almost complete integration of the apparatus for reducing the restoring force in the transport wheel is achieved whereby each receptacle has two first holders where the two first holders receive one of the two outer fold edges and one of the two inner fold edges of the package sleeve, each receptacle has two second holders where the two second holders receive the other of the two outer fold edges and the other of the two inner fold edges of the package sleeve, that the two first holders are disposed in a fixed position on the transport wheel and the second holders are disposed pivotably on the transport wheel in such a manner that due to the pivoting movement of the two second holders, two opposite package walls are each pivotable parallel to one another about one of the two outer fold edges. As a result of the pivoting of the two second holders whilst the transport wheel is at a standstill or during turning of the transport wheel, the internal angle between the package walls at the outer fold edges is increased to more than 90° and the restoring force thereby broken.

A further advantage of a filling machine with pivotably arranged holders consists in that the transfer of the upright package sleeve to the downstream transport device can already take place when the flat-folded package sleeve is erected in cross-section to form a parallelogram whose cross-section is merely about ⅓ of the rectangular cross-section of the completely upright package sleeve. The package sleeve merely partially erected in such a manner is pushed into the receptacle of the transport wheel which as a result of the pivotably mounted second holders is able to securely receive the partially erected package sleeve. As a result, the complete erection of the flat-folded package sleeve can be partially shifted into the downstream transport device.

According to an embodiment of the invention, the two second holders of each receptacle are mechanically interconnected and form the coupler of a mechanical linkage that is disposed on the transport wheel. In the same way, the two first holders can be interconnected to form a single profile. The pivoting movement of the two second holders initially brings about the complete erection of the package sleeve until this has a rectangular or square cross-section. In the course of the further pivoting movement, the restoring force is reduced. The filling machine has an apparatus for pivoting the two second holders and therefore also for reducing the restoring force.

The apparatus comprises a cylinder cam mechanism comprising a cylindrical fixed cam body which is disposed coaxially to the axis of rotation of the transport wheel, a cylinder cam disposed in the cam body, a scanning element guided in the cylinder cam and a linkage which is connected on one side to the scanning element and on the other side to the second holders. The cylinder cam in the cam body is configured in such a manner that initially the second pair of holders erects the package sleeve to form a rectangle or square. The further course of the cylinder cam brings about a continuation of the pivoting movement, whereby the internal angle between the package walls at the outer fold edges is increased to more than 90°. Such a configuration of the cylinder cam has the effect that the apparatus for reducing the restoring force is active during turning of the transport wheel.

If the apparatus described previously for reducing the restoring force is to be activatable when the stepwise operable transport wheel is at a standstill, at least one section of the cylinder cam is disposed in a segment of the cam body displaceable in the direction of the axis of rotation. The scanning element reaches this section of the cylinder cam at the time when the package sleeve is erected to form a rectangle or square. The section of the cylinder cam is then displaced, for example, with a mechanically actuated tappet, from an initial position in the direction of the axis of rotation of the transport wheel whereby the pivoting movement of the second holders is continued despite the transport wheel being at a standstill. After pivoting of the second holder for the purpose of reducing the restoring force, the displaceably guided segment of the cam body is withdrawn into its initial position so that the section of the cylinder cam in the displaceable segment is again in alignment with the other cylinder cam disposed in the fixed cam body. In the subsequent course, the cylinder cam is configured to be annular so that the second holders are no longer moved by means of the linkage during the subsequent turning of the transport wheel by a step angle until they are pivoted during turning through the last step angle before reaching the transfer position of the transport wheel such that the merely partially upright package sleeve can be inserted into the receptacle.

BRIEF DESCRIPTION OF THE DRAWINGS

The invention is explained in detail hereinafter with reference to the figures. In the figures:

FIGS. 4*a-d* show schematic views to illustrate the removal and unfolding of package sleeves from a magazine of a filling machine according to FIGS. 2 and 3, FIGS. 5*a-b* show schematic views to illustrate the reduction of the restoring force in a filling machine according to FIGS. 2 and 3, FIGS. 10*a-c* show schematic view to illustrate the reduction of the restoring force in a filling machine according to FIGS. 9*a-f*.

DETAILED DESCRIPTION OF THE PREFERRED EMBODIMENTS

Figure 1A:
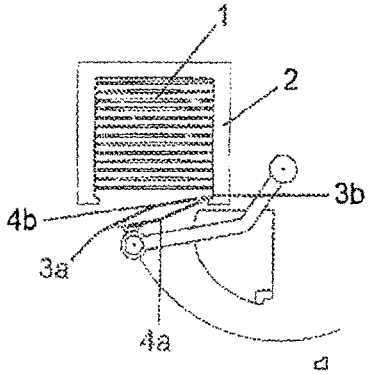
Figure 1a) Prior Art
FIGS. 1*a-d* shows schematic views of a prior art filling machine to illustrate removal and unfolding of package sleeves from a magazine.
Figure 1B:
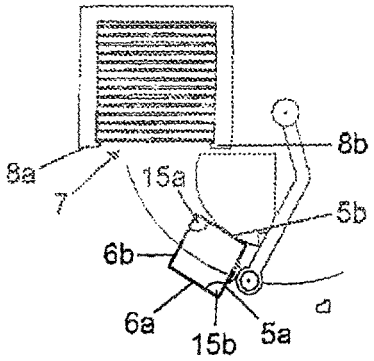
Figure 1b) Prior Art
Figure 1C:
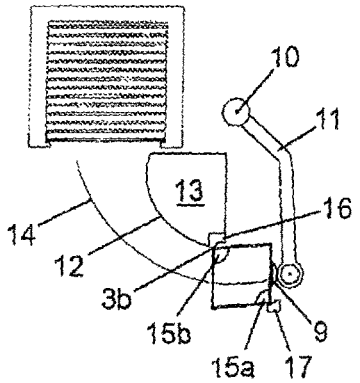
Figure 1c) Prior Art
Figure 1D:
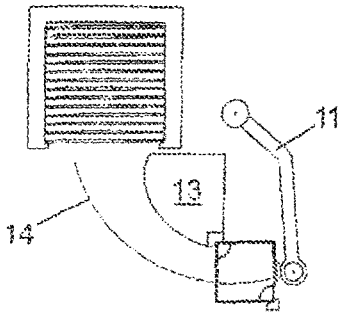
Figure 1d) Prior Art

Insofar as the filling machines according to the invention for filling liquid foodstuffs into packaging containers, shown in part in FIGS. 2-10, comprise the same components as the filling machine according to the prior art, shown in part in FIG. 1, the same reference numbers are used. In addition, reference is additionally made to the explanations for the filling machine shown in FIG. 1.

The magazine (2) for receiving the flat-folded package sleeves (1) for producing the packaging containers is disposed on a frame (20) of the filling machine according to FIGS. 2-5 at the beginning of the conveyor line. The magazine (2) comprises retaining profiles (21*a, b*) which come to rest on the outer fold edges (3*a, b*) of the package sleeves (1). The removal side (7) of the magazine (2) exposes the two front package walls (5*a, b*) of the overall four package walls (5*a, b*, 6*a, b*) of the respectively front package sleeve (1). The removal and unfolding apparatus located downstream of the magazine (2) on the conveyor line of the filling machine comprises a suction gripper (9) having three pneumatic suckers for gripping the package wall (5*a*) exposed on the removal side (7). The suction gripper (9) is disposed displaceably along a rectilinear movement path (23) perpendicular to the exposed package wall (5*a*).

The removal and unfolding apparatus furthermore has a flat guide surface (24) for the outer fold edge (3*b*) of the other of the two exposed package walls (5*b*) of the package sleeve (1). The flat guide surface (24) guides the outer fold edge (3*b*) in a sliding manner.

Located after the flat guide surface (24) in the direction of the movement path (23) is a fixed retaining element (17) for receiving the outer fold edge (3*a*). The retaining element (25) for receiving the diametrically opposite outer fold edge (3*b*) can be moved to and fro by means of a linear drive between an initial position shown in FIGS. 4*a-c* and an end position shown in FIG. 4*d*. Both the fixed retaining element (17) and also the moveable retaining element (25) are configured as an angle profile. The two surfaces of the angle profiles disposed at an angle to one another come to rest against the package walls (5*a*, 6*a* or 5*b*, 6*b*) in the end position shown in FIG. 4*d*.

As can be seen in particular from FIGS. 4*a-d*, the distance between the flat guide surface (24) and the movement path (23) of the suction gripper (9) decreases continuously in the direction from the magazine (2) to the retaining elements (17, 25).

In order to transfer the package sleeve (1) completely erected by the retaining elements (17, 25), forming a square in cross-section, to a transport device (26) of the filling machine located downstream of the removal and unfolding apparatus, the suction gripper (9) can be moved vertically up and down by means of an actuator (22).

The transport device (26) comprises a transport wheel (29) which is rotatable about an axis of rotation (28*a*) comprising four radially outwardly extending receptacles each having a first profile (30) and two second profiles (31). The first profile (30) is designed as an angular guide and can be brought to rest on the outer fold edge (3*b*). The two second profiles (31) are designed as rod profiles and can be brought to rest directly adjacent to the outer fold edge (3*a*). The first and second profiles (30, 31) form cells into which the unfolded package sleeves having rectangular cross-section can be inserted. The axis of rotation (28*a*) of the transport wheel (29) lies in a plane transverse to the conveyor line (23) of the filling machine. The transport wheel (29) is turned in a stepwise manner by 90° in each case about the axis of rotation (28*a*) by a drive not shown. From the transport wheel (29) shown, the unfolded package sleeves (1) are transferred to other transport devices not shown in the figures in order to perform further processing steps on the package sleeves.

An apparatus (32) for reducing the restoring force is disposed on the transport device. The apparatus (32) for reducing the restoring force comprises a push element (33) that is connected via an arm (34) to a movement drive (35). The push element (33) designed as an angle profile extends parallel to the outer fold edge (3*a*) at which it can be temporarily brought to rest, where the fold edges (3*a*) rest against the edge (36) formed between the legs of the angle profile on the inner side thereof. The movement drive (35) is fastened to the frame (20) of the filling machine.

The filling machine according to FIGS. 2, 3 operates as follows:

After removing and unfolding the package sleeve (1), this is inserted into the downwardly pointing receptacle of the transport wheel (29). The transport wheel (29) is then turned in the anticlockwise direction (37) through a step angle of 90° with the aid of a drive not shown, so that the previously loaded receptacle comes into a horizontal, right-pointing standstill position. In this standstill position of the transport wheel (29), the movement drive (35) of the apparatus for reducing the restoring force is activated so that the push element (33) comes to rest on the outer fold edge (3*a*). In the course of the further movement of the push element (33), the package walls (5*a*, 6*a*) become detached from the rod-shaped second profiles (31) whilst the outer fold edges (3*a, b*) move towards one another in the direction of the cross-sectional diagonals (38). The internal angle (39) between the package walls (5*a*, 6*a* or 5*b*, 6*b*) at the outer fold edges (3*a, b*) is thereby increased to more than 90°, as can be seen clearly from FIG. 5*b*. This enlargement of the internal angle (39) breaks the pre-tensioning force in the fold edges (3*a, b*) and the inner fold edges (4*a, b*). The push element (33) is then withdrawn into the initial position with the aid of the movement drive (35) so that the package sleeve (1) again has a rectangular cross-section but with reduced restoring force. The transport wheel (29) is then turned further through a step angle of 90° whereby the next package sleeve (1) received previously by the perpendicularly downwardly pointing receptacle comes into the horizontally right-pointing standstill position and a reduction in the restoring force is accomplished.

Figure 2:
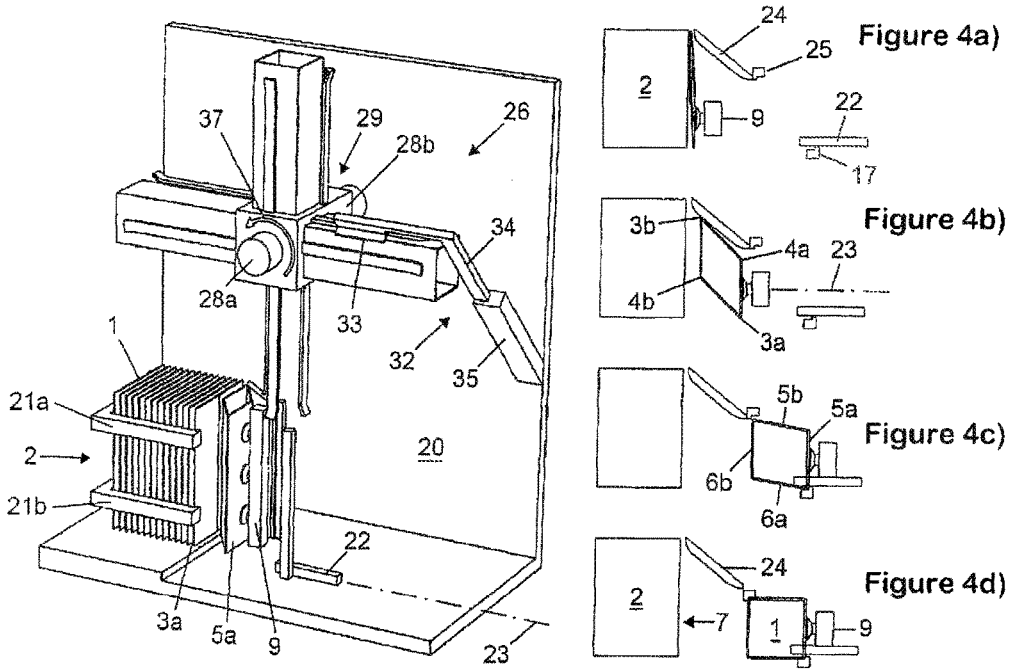
FIG. 2 shows a schematic perspective partial view of a filling machine before activation of an apparatus for reducing the restoring force.
Figure 3:
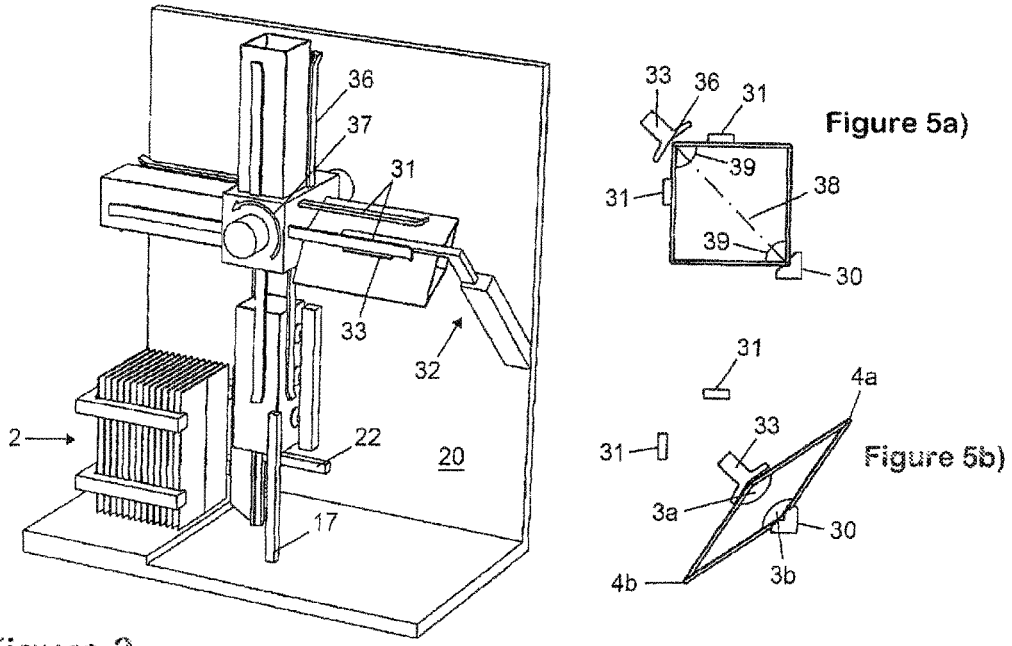
FIG. 3 shows a partial view of the filling machine according to FIG. 2 during activation of the apparatus for reducing the restoring force.
Figure 6:
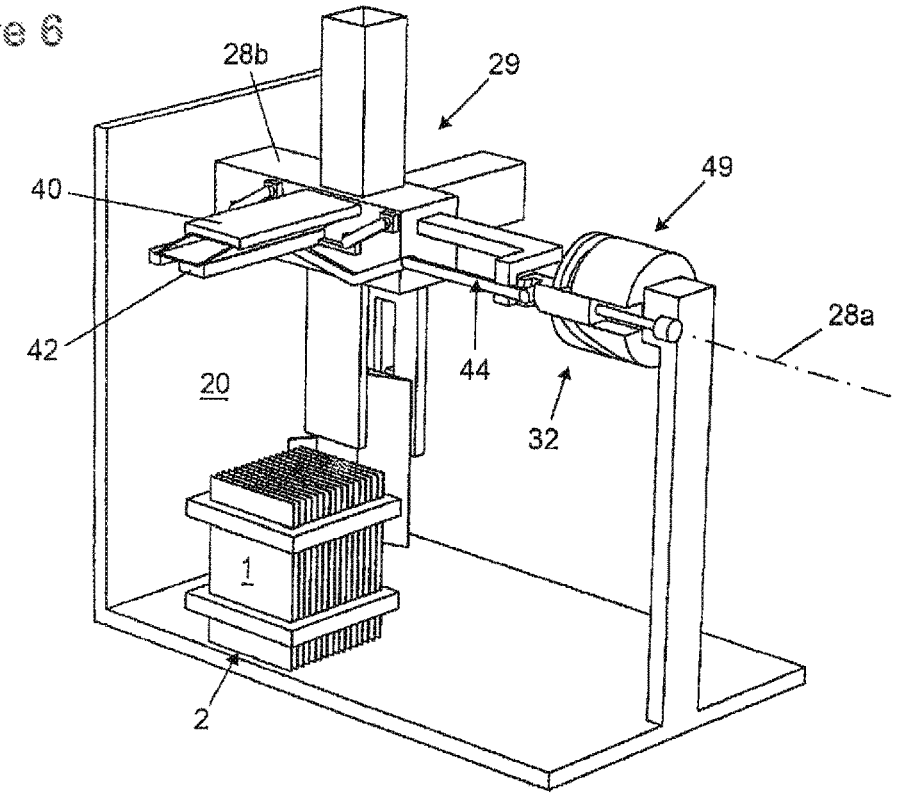
FIG. 6 shows a schematic perspective partial view of a second exemplary embodiment of a filling machine during the reduction of the restoring force at a package sleeve and simultaneous transfer of another package sleeve to a transport device.
Figure 7:
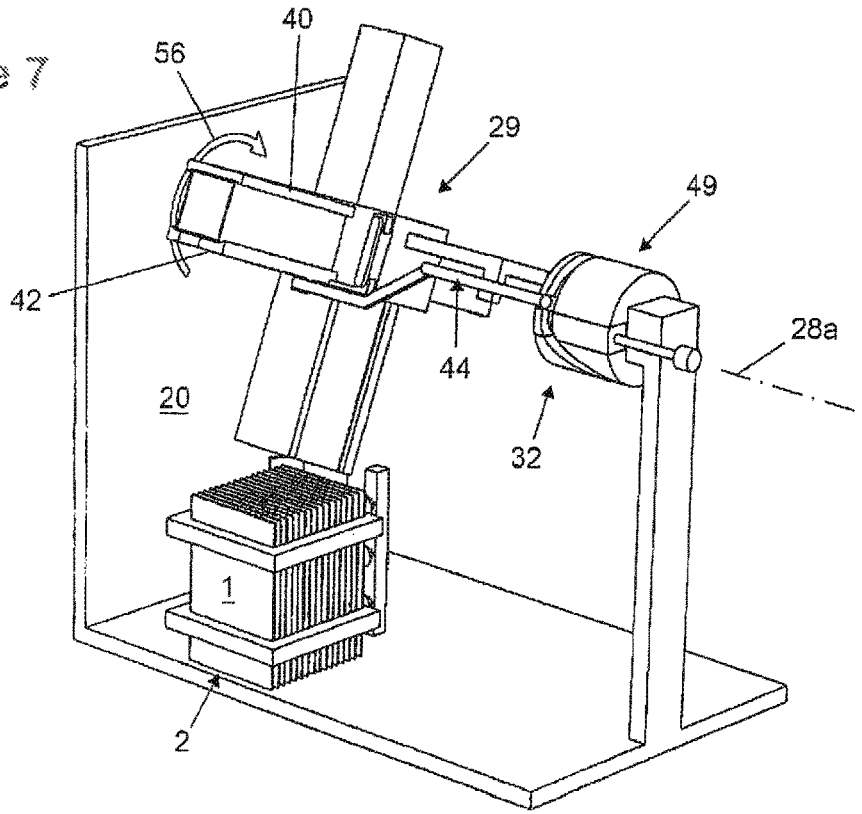
FIG. 7 shows a partial view of the filling machine from FIG. 6 during the turning of the transport wheel.

The filling machine shown in part in FIGS. 6 and 7 differs from the filling machine shown in FIGS. 2 and 3 in that a package sleeve (1) which has not yet been completely erected to form a rectangle or square is transferred to the downward-pointing receptacle of the transport wheel (29). Furthermore the apparatus (32) for reducing the restoring force is constructed differently. Insofar as the filling machine shown in FIGS. 6 and 7 has the same components as the filling machine shown in part in FIGS. 2 and 3, the same reference numbers are used. In addition, reference is made to the explanations there to avoid repetitions.

The transport wheel (29) also has four receptacles, where each receptacle comprises a first radially outwardly extending profile (40) that is disposed in a fixed position on the transport wheel (29). The first profile (40) is angled at the side edges. The angled profile regions form first holders (41) for receiving the outer fold edge (3*a*) and the inner fold edge (4*a*) of the package sleeve (1). A second profile (42) also extends radially outwards and is also angled in the edge regions. The angled regions form second holders (43) for receiving the other outer fold edge (3*b*) and the other inner fold edge (4*b*) of the package sleeve (1). The second profile (42) is designed as a coupler of a mechanical linkage having four articulations, that converts a rectilinear movement of a linkage (44) into an oscillating movement of the second profile (42). The mechanical linkage has two motion links (45) which are articulated at one end to side arms (46) disposed in extension of the second profile (42) and which are articulated at the other end in an articulated manner on the axle body (28*b*) of the transport wheel (29). The motion links (45) move parallel to the side walls (6*a*, 5*b*) of the package sleeve (1).

The linkage (44) is designed in two parts. The linkage is divided into an angled part (44*a*) and a rectilinear part (44*b*). The angled part (44*a*) articulated to the underside of the second profile (42). At the opposite end the angled part (44*a*) is connected in an articulated manner to the rectilinear part (44*b*). The rectilinear part (44*b*) is connected to a scanning element (47) in the form of a cam roller at the end remote from the linkage. The rectilinear section (44*b*) is forcibly guided by a guide element (48) connected in a torque-proof manner to the axle body (28*b*) in the direction of the axis of rotation (28*a*) of the transport wheel (29). The scanning element (47) is part of a cylinder cam mechanism (49). The cylinder cam mechanism (49) comprises a cam body (50) disposed in a fixed position on the frame (20) coaxially to the axis of rotation (28*a*) of the transport wheel (29). A cylinder cam (51) in the form of a groove which guides the scanning element (47) is inserted in the cam body (50). A section (52) of the cylinder cam (51) is part of a segment (53) of the cam body (50) which is displaceable in the direction of the axis of rotation (28*a*). The segment (53) can be moved to and fro in a link (54) of the cam body (50) by means of an actuating member (55). The movement is accomplished with the aid of a drive not shown for the sake of clarity.

The method for reducing restoring forces in package sleeves (1) in a filling machine according to FIGS. 6 and 7 is explained in detail hereinafter with reference to FIGS. 8*a-d*.

Figure 8A:
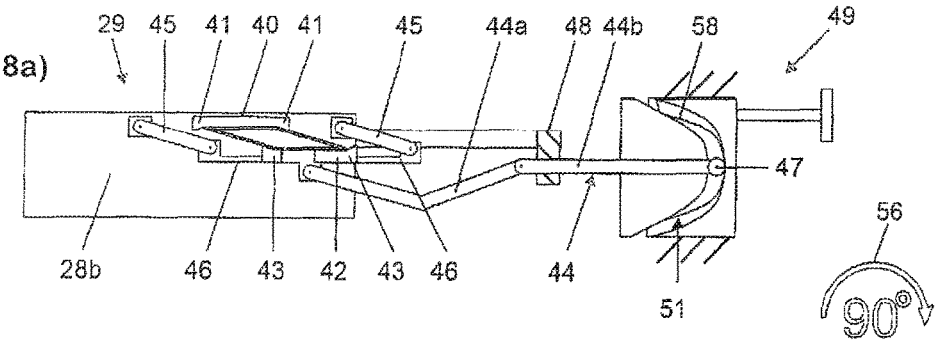
FIGS. 8*a-d* show schematic views to illustrate the reduction of the restoring force in a filling machine according to FIGS. 6 and 7, FIGS. 9*a-f* show schematic perspective partial views of a third exemplary embodiment of a filling machine in which the reduction of the restoring force takes place during a turning of the transport wheel
Figure 8B:
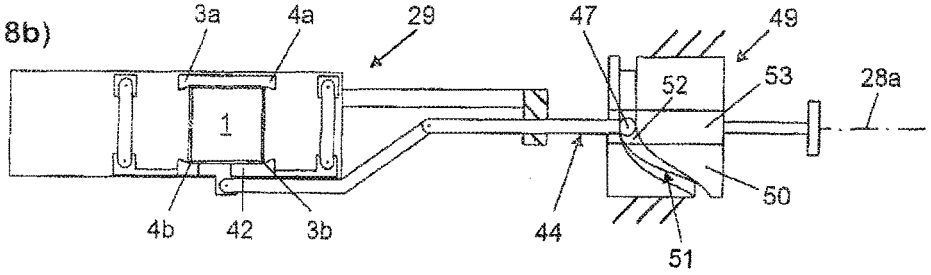
Figure 8C:
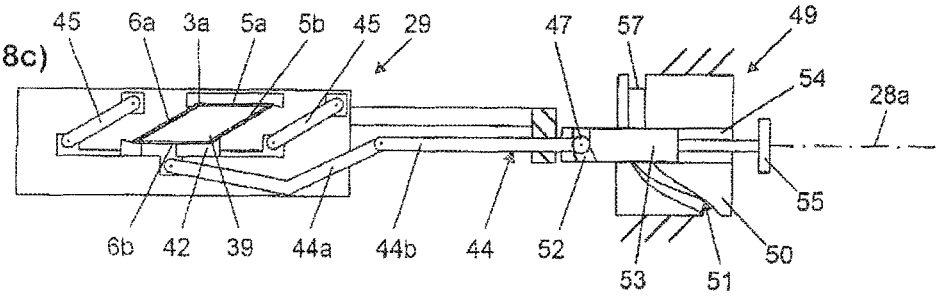
Figure 8D:
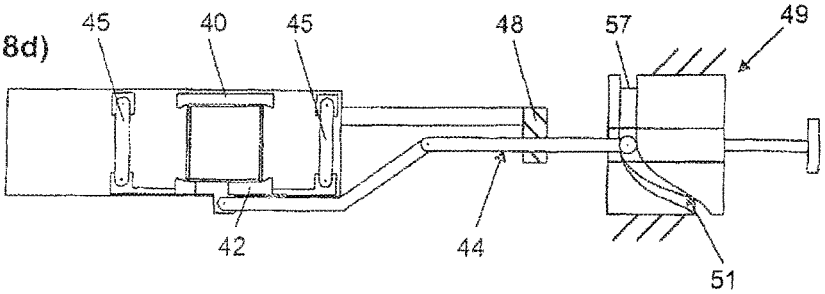

FIG. 8*a* shows a view of the downwardly pointing receptacle of the transport wheel (29). In this position of the receptacle, the package sleeve (1) erected only partially to form a parallelogram is inserted into the receptacle. In the present exemplary embodiment the package sleeve (1) is erected to form a diamond which comprises approximately ⅓ of the square cross-section of the completely erected package sleeve (1). The transport wheel (29) is then turned further in the clockwise direction (56) through a step angle of 90° so that the receptacle points horizontally left (cf. FIG. 6). During this turning through 90°, the scanning element (47) is guided in the cylinder cam (51) inwards in the direction of the transport wheel (29), whereby the linkage (44) pivots the second profile (42) into the standstill position shown in FIG. 8*b*. In the standstill position of the receptacle shown in FIG. 8*b*, in which this points horizontally to the left, the package sleeve (1) is erected to form a square in cross-section. In order to now reduce the restoring forces caused by the fold edges (3*a, b*, 4*a, b*) in the package sleeve (1), the internal angle (39) between the package walls (5*a*, 6*a* or 5*b*, 6*b*) at the outer fold edges (3*a* or 3*b*) is increased to more than 90°. In the horizontal left-pointing position of the receptacle shown in FIG. 8*b, c*, the scanning element (47) is located in the section (52) of the displaceably disposed segment (53) of the cam body (50). With the aid of the actuating member (55), the segment (53) is now displaced in the direction of the axis of rotation (28*a*) inwards in the direction of the transport wheel (29), whereby the second profile (42) swings into the opposite position to FIG. 8*a*), according to FIG. 8*c*). By this means the internal angle (39) is increased to a value of more than 90°, in the exemplary embodiment shown of about 130°. Then, during the standstill in the left-pointing position of the receptacle, the actuating member (55) is withdrawn until the section (52) is again in alignment with the remainder of the cylinder cam (51) as can be seen in FIG. 8*d*).

Two further rotations of the transport wheel (29) through a step angle of 90° in each case now take place, where the package sleeve (1) which is completely upright and overstretched in its fold edges preserves its square cross-section. This is achieved by guiding the scanning element (47) during the subsequent two rotations through step angles of 90° in each case in an annular section (57) of the cylinder cam (51). As soon as the receptacle points horizontally to the right, the upright package sleeve is transferred with reduced restoring force to a following transport device not shown for the sake of clarity. During the subsequent rotation of the receptacle from this transfer position through 90° into this downward-pointing receiving position (FIG. 8*a*), the scanning element (47) is guided in the outwardly guided section (58) of the cylinder cam (51), whereby the pivotable second profile (42) again goes into the position shown in FIG. 8*a* for receiving another partially erected package sleeve (1).

The filling machine according to the invention shown in part in FIGS. 9*a-f* largely corresponds to the filling machine according to FIGS. 6 and 7. Insofar as the filling machine has the same components, the same reference numbers are used. In addition, reference is additionally made to the explanations for the filling machine according to FIGS. 6, 7.

Figure 9A:
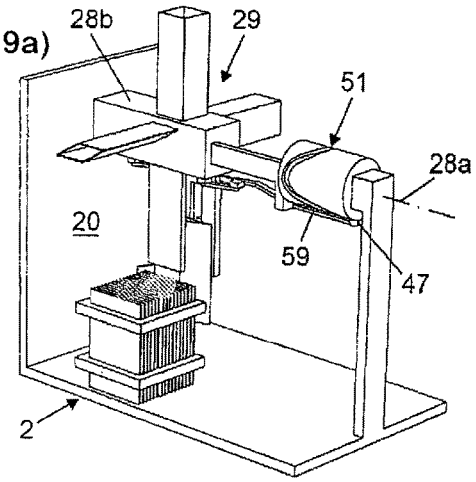
Figure 9B:
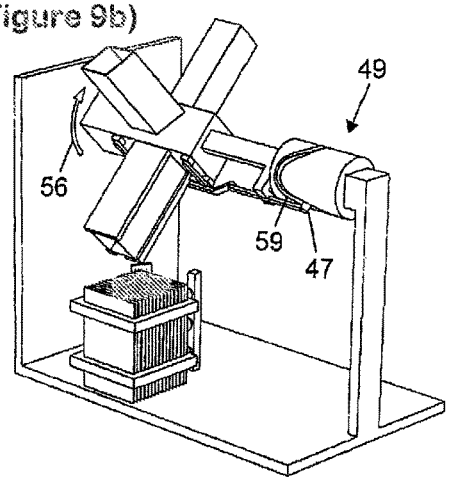
Figure 9C:
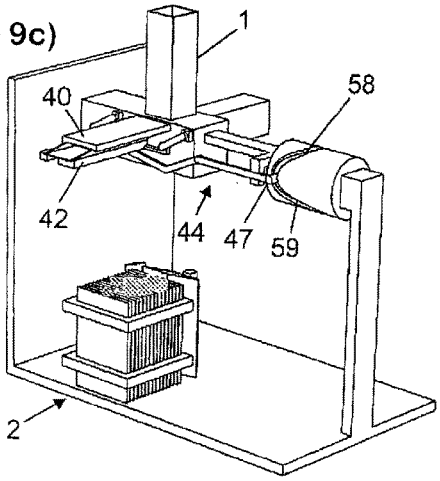
Figure 9D:
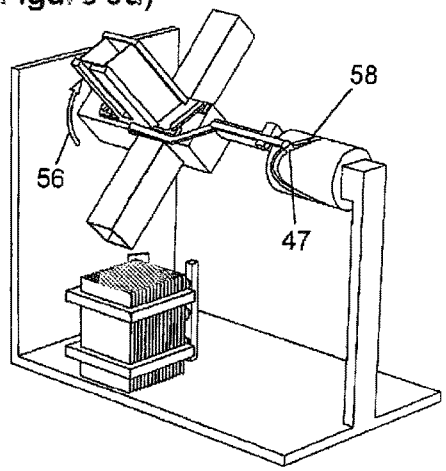
Figure 9E:
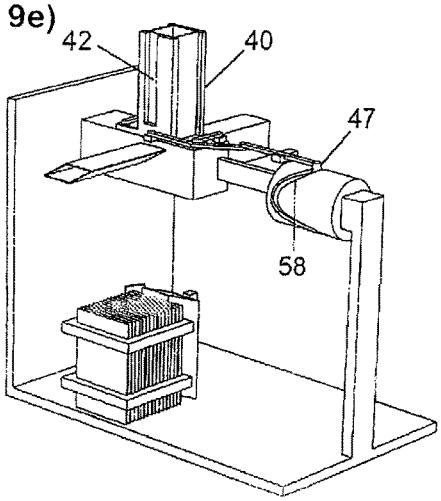
Figure 9F:
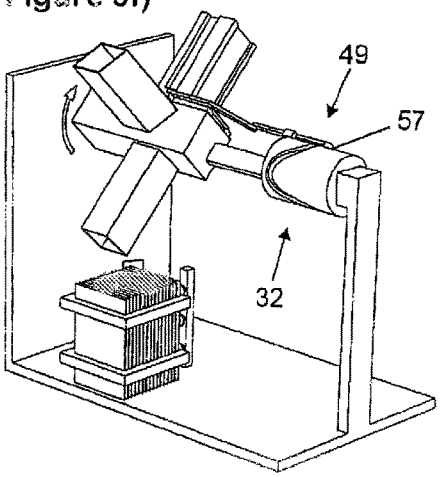

The essential difference between the filling machine according to FIGS. 9*a*)-*f*) and the filling machine according to FIGS. 6 and 7 is that the reduction in the restoring force takes place exclusively during a movement of the upright package sleeve (1) along the transport path of the transport wheel (29) but not when the transport wheel is at a standstill, as in the exemplary embodiment of the filling machine according to FIG. 2 or 6 and 7. The receptacles of the transport wheel are configured in the same way as in the exemplary embodiment according to FIGS. 6 and 7 so that in this respect reference is made to the explanations there. The apparatus (32) for reducing the restoring force differs from that for the filling machine according to FIGS. 6 and 7 in that no section (52) of the cylinder cam (51) is disposed in a displaceable segment (53) of the cam body (50). A displaceable segment (53) can be dispensed with since the movement of the second profile (42) is brought about only by the movement of the scanning element (47) in the continuous cylinder cam (51) during the rotation of the transport wheel (29).

The complete erection of the package sleeve and the subsequent overstretching of the package edges (3*a, b*, 4*a, b*) is explained in detail hereinafter:

FIGS. 9*a*), 10*a*) show the transport wheel (29) with the downward-pointing receptacle in which the package sleeve (1) erected to form a non-square parallelogram in cross-section is received. The scanning element (47) is located in the cylinder cam (51) at the greatest possible distance from the transport wheel (29). During the subsequent turning of the transport wheel in the clockwise direction (56) through a step angle of 90°, the scanning element (47) is guided on an inwardly guided section (59) of the cylinder cam (51) in the direction of the transport wheel (29), whereby the linkage (44) pivots the second profile (42) into the position shown in FIGS. 9*c*), 10*b*). In this position the two internal angles (39) between the package walls at the outer fold edges (3*a, b*) are increased to an angle of more than 90°, in the exemplary embodiment shown, of more than 140° and the restoring forces emanating from the fold edges (3*a, b*, 4*a, b*) are thereby reduced.

The transport wheel (29) is then rotated further through another step angle of 90°, whereby the scanning element (47) runs through an outwardly guided section (58) of the cylinder cam (51). The second profile (42) is thereby pivoted by means of the linkage (44) into the position shown in FIGS. 10*c*), 9*e*), in which the package sleeve (1) has the desired square cross-section with reduced restoring forces. The receptacle points upwards. In this position a processing step can be performed on the completely upright package sleeve such as, for example, forming the package base.

In the position rotated further through a step angle of 90° in the clockwise direction (56), in which the receptacle points horizontally to the right, the processed package sleeve (1) can be transferred to a downstream transport device. The turning movement between the position with upwardly pointing receptacle into the position with horizontally right-pointing receptacle is accomplished without further pivoting of the second profile. To this end, the scanning element (47) is guided in an annular section (57) of the cylinder cam (51) which can be seen from FIG. 10*c*).

The previously described apparatus according to FIG. 9 is used in particular when the cardboard packagings processed in the filling machine have largely the same condition and the magnitude of the oscillation amplitude of the second profile (42) need not be varied for reducing the restoring force. The apparatus according to FIGS. 6, 7 is however used in particular in those filling machines in which package sleeves (1) having different cardboard conditions are processed. The amplitude of the oscillating motion of the second profile (42) can be adapted to the condition of the cardboard by means of the setting of the stroke of the displaceably guided segment (53).

REFERENCE LIST

| No. | Description |
|---|---|
| 1 | Package sleeve |
| 2 | Magazine |
| 3a, b | Outer fold edges |
| 4a, b | Inner fold edges |
| 5a, b | Package walls |
| 6a, b | Package walls |
| 7 | Removal side |
| 8 | Retaining elements |
| 9 | Suction gripper |
| 10 | Axis |
| 11 | Pivot arm |
| 12 | Guide surface |
| 13 | Guide elements |
| 14 | Movement path |
| 15a, b | Internal angle |
| 16 | Retaining elements |
| 17 | Retaining elements |
| 18 | — |
| 19 | — |
| 20 | Frame |
| 21a, b | Retaining profiles |
| 22 | Actuator |
| 23 | Movement path |
| 24 | Guide surface |
| 25 | Retaining element |
| 26 | Transport device |
| 27 | Sleeve slider |
| 28a | Axis of rotation |
| 28b | Axle body |
| 29 | Transport wheel |
| 30 | First profile (angle profile) |
| 31 | Second profile (rod profile) |
| 32 | Apparatus for reducing the restoring force |
| 33 | Push element |
| 34 | Arm |
| 35 | Movement drive |
| 36 | Edge (angle profile) |
| 37 | Anticlockwise direction |
| 38 | Cross-sectional diagonal |
| 39 | Internal angle |
| 40 | First profile |
| 41 | First holder |
| 42 | Second profile |
| 43 | Second holder |
| 44 | Linkage |
| 45 | Motion links |
| 46 | Side arms |
| 47 | Scanning element (cam roller) |
| 48 | Guide element |
| 49 | Cylinder cam mechanism |
| 50 | Cam body |
| 51 | Cylinder cam |
| 52 | Section |
| 53 | Segment |
| 54 | Link |
| 55 | Actuating member |
| 56 | Clockwise direction |
| 57 | Annular section |
| 58 | Outwardly guided section |
| 59 | Outwardly guided section |

The invention claimed is:

1. A method for reducing restoring forces of package sleeves in a filling machine, comprising the process steps:

providing a magazine having flat-folded package sleeves, each of the flat-folded package sleeves comprises four parallel-running package walls separated from one another by folding edges, wherein the folding edges include outer fold edges and inner fold edges, and one acute internal angle at the outer fold edges is enclosed between the package walls, removing one of the flat-folded package sleeves from the magazine, unfolding the one of the flat-folded package sleeves to form an unfolded package sleeve forming a parallelogram in cross-section using a removal and unfolding apparatus, wherein the internal angle between the package walls at the outer fold edges is smaller than or equal to 90° during the step of unfolding, transferring the unfolded package sleeve using a transfer apparatus to a transport device downstream of the removal and unfolding apparatus and transporting the unfolded package sleeve along a transport path of the transport device, wherein at least one processing step is carried out on the unfolded package sleeve while the unfolded package sleeve is located on the transport path of the transport device, wherein the transport device is configured as a transport wheel with a plurality of radially outwardly extending receptacles, each of the receptacles configured for receiving one package sleeve and having a plurality of profiles at least one of at and adjacent to the folding edges of the package sleeve for contact therewith, and wherein the transport device has a drive for rotating the transport wheel about a rotational axis, and reducing the restoring force by temporarily increasing the internal angle between the package walls at the outer fold edges to more than 90° while the unfolded package sleeve is located on the transport wheel of the transport device, the transport device being operated in a stepwise manner, and the step of reducing the restoring force is accomplished during one of a standstill of the unfolded package sleeve on the transport path or during movement of the unfolded package sleeve along the transport path of the transport device.

2. The method according to claim 1, wherein the internal angle between the package walls at the outer fold edges is increased to more than 90° by moving the outer fold edges towards one another in the direction of a cross-sectional diagonal between the outer fold edges of the unfolded package sleeve during the step of reducing.

3. The method according to claim 1, wherein the internal angle between the package walls at the outer fold edges is increased to more than 90° by pivoting two opposite package walls parallel to one another in each case about one of the outer fold edges during the step of reducing.

4. The method according to claim 1, wherein the internal angle between the package walls at the outer fold edges is increased to an angle in the range between 120° to 180° during the step of reducing.

5. A filling machine for filling products into package containers, comprising:

a magazine for receiving flat-folded package sleeves for producing the package containers, wherein each flat-folded package sleeve comprises four package walls separated from one another by outer fold edges and inner fold edges, with an acute internal angle at the outer fold edges enclosed between the package walls, a removing and unfolding apparatus for removing one of the flat-folded package sleeves from the magazine and unfolding the one of the flat-folded package sleeves to form an unfolded package sleeve forming a parallelogram in cross-section, wherein the internal angle between the package walls at the outer fold edges is smaller than or equal to 90° in the removing and unfolding apparatus, a transfer apparatus for transferring the unfolded package sleeve to a downstream transport device, the transport device transporting the unfolded package sleeve along a transport path, the transport device having a transport wheel with a plurality of radially outwardly extended receptacles for receiving the unfolded package sleeve, each of the receptacles having a plurality of profiles configured to be disposed at and/or adjacent to the inner fold edges of the unfolded package sleeve for contact therewith when the unfolded package sleeve is received in the each of the receptacles, and the transport device having a drive for turning the transport wheel about an axis of rotation, and means for reducing the restoring force of the unfolded package sleeve while the unfolded package sleeve is located on the transport wheel of the transport device.

6. The filling machine according to claim 5, wherein the drive is configured as a stepping drive configured to bring the receptacles for the package sleeves into a standstill position after turning the transport wheel by a step angle, the means for reducing the restoring force being activated while the transport wheel is at a standstill.

7. The filling machine according to claim 6, wherein each of the receptacles has at least one first profile that can be brought to rest against one of the outer fold edges of the package sleeve and the each of the receptacles has at least two second profiles that can be brought to rest against another of the outer folds edges of the package sleeve.

8. The filling machine according to claim 6, the each of the receptacles has two first holders which receive one of the outer fold edges and one of the inner fold edges of the package sleeve, two second holders which receive another of the outer fold edges and another of the inner fold edges of the package sleeve, the two first holders being disposed in a fixed position on the transport wheel and the second holders being disposed pivotably on the transport wheel so that due to the pivoting movement of the two holders, two opposite package walls are pivotable parallel to one another about one of the two outer fold edges.

9. The filling machine according to claim 8, wherein the means for reducing the restoring force comprises a cylinder cam mechanism with a cylindrical fixed cam body disposed coaxially to the axis of rotation of the transport wheel, a cylinder cam disposed in the cam body, a scanning element guided in the cylinder cam, and a linkage connected on one side to the scanning element and on the other side to the second pivotable holders.

10. The filling machine according to claim 9, wherein at least one section of the cylinder cam is disposed in a segment of the cam body displaceable in the direction of the axis of rotation.

11. The filling machine according to claim 6, wherein the means for reducing the restoring force comprises a push element that acts temporarily on at least one of the outer fold edges and is movable in the direction of a cross-sectional diagonal running between the outer fold edges of the upright unfolded package sleeve.

12. The filling machine according to claim 5, wherein the drive is configured as a stepping drive configured to bring the receptacles for the package sleeves into a standstill position after turning the transport wheel by a step angle, the means for reducing the restoring force being activated during the turning of the transport wheel.

13. The filling machine according to claim 12, the each of the receptacles has two first holders which receive one of the outer fold edges and one of the inner fold edges of the package sleeve, two second holders which receive another of the outer fold edges and another of the inner fold edges of the package sleeve, the two first holders being disposed in a fixed position on the transport wheel and the second holders being disposed pivotably on the transport wheel so that due to the pivoting movement of the two holders, two opposite package walls are pivotable parallel to one another about one of the outer fold edges.

14. The filling machine according to claim 13, wherein the means for reducing the restoring force comprises a cylinder cam mechanism with a cylindrical fixed cam body disposed coaxially to the axis of rotation of the transport wheel, a cylinder cam disposed in the cam body, a scanning element guided in the cylinder cam, and a linkage connected on one side to the scanning element and on the other side to the second pivotable holders.

15. The filling machine according to claim 14, wherein at least one section of the cylinder cam is disposed in a segment of the cam body displaceable in the direction of the axis of rotation.

* * * * *